US011608224B2

(12) United States Patent
Fluke et al.

(10) Patent No.: US 11,608,224 B2
(45) Date of Patent: Mar. 21, 2023

(54) FLEXIBLE CARGO CONTAINER

(71) Applicant: Seguro Products, LLC, Beaumont, TX (US)

(72) Inventors: Randall Fluke, Beaumont, TX (US); Emily Fluke, Beaumont, TX (US); Caroline Erck, Houston, TX (US); John Erck, Houston, TX (US); Austin Fluke, Ocean Springs, MI (US)

(73) Assignee: Seguro Products, LLC, Houston, TX (US)

( * ) Notice: Subject to any disclaimer, the term of this patent is extended or adjusted under 35 U.S.C. 154(b) by 53 days.

(21) Appl. No.: 17/315,452

(22) Filed: May 10, 2021

(65) Prior Publication Data

US 2021/0354909 A1 Nov. 18, 2021

Related U.S. Application Data

(60) Provisional application No. 63/026,191, filed on May 18, 2020.

(51) Int. Cl.

| | |
|---|---|
| ***B65D 88/22*** | (2006.01) |
| ***B65D 88/52*** | (2006.01) |
| ***B65D 90/00*** | (2006.01) |
| ***B65D 90/02*** | (2019.01) |
| ***B65D 90/08*** | (2006.01) |

(52) U.S. Cl.

CPC ..... *B65D 88/22* (2013.01); *B65D 88/522* (2013.01); *B65D 90/0066* (2013.01); *B65D 90/021* (2013.01); *B65D 90/08* (2013.01); *B65D 2588/16* (2013.01); *B65D 2590/02* (2013.01)

(58) Field of Classification Search

CPC ..... B65D 35/08; B65D 2590/02; B65D 2588/16; B65D 90/08; B65D 90/021; B65D 90/0066; B65D 88/22; B65D 88/522; B65D 88/16; B60R 13/01; B60R 2013/018

See application file for complete search history.

(56) References Cited

U.S. PATENT DOCUMENTS

| | | | | |
|---|---|---|---|---|
| 5,205,602 | A * | 4/1993 | Hoare | B60R 13/01 410/82 |
| 5,378,034 | A * | 1/1995 | Nelsen | B60R 9/00 220/666 |
| 6,105,842 | A * | 8/2000 | Cesare | B60R 9/00 224/404 |
| 8,429,777 | B2 * | 4/2013 | Svoboda | A47C 31/007 5/699 |
| 2010/0270297 | A1 * | 10/2010 | Villers | B65D 90/048 53/469 |

* cited by examiner

*Primary Examiner* — Stephen J Castellano
(74) *Attorney, Agent, or Firm* — Wiley Rein LLP

(57) ABSTRACT

The present disclosure is a soft-shell cargo container that is ideal for "do-it-yourself" transport. The cargo container, which may be useful in a pickup truck bed, includes a single piece of a flexible shell material that defines a base panel, a front wall panel, back wall panel, two side wall panels, a top cover panel, and a tailgate panel. The cargo container is flexible and therefore adaptable to cover bulky or awkwardly shaped cargo. The cargo in the cargo container can be secured via interior fasteners, like loops, hooks, straps, and dividers. The cargo container can also be waterproof, fire retardant, puncture proof, and lockable. Thus, the cargo container protects belongings therein from weather damage, debris, and theft.

25 Claims, 7 Drawing Sheets

FLEXIBLE CARGO CONTAINER

CROSS-REFERENCE TO RELATED APPLICATIONS

This application claims the benefit of U.S. provisional application No. 63/026,191, filed 18 May 2020, which is hereby incorporated by reference as though fully set forth herein.

FIELD

The instant disclosure generally pertains to the field of cargo storage, and in particular, to a soft-sided cargo container, such as for use in a pickup truck bed or other open-air environment.

BACKGROUND

Many drivers of pickup trucks appreciate and utilize the cargo space on the bed of the truck for transporting large items due to a lack of room in the cab. Yet, because the truck bed is exposed, use of the truck bed for extended storage may be undesirable. For example, inclement weather can damage items stored in the truck bed. Likewise, items stored in the truck bed may be inviting targets for thieves.

Remedies for this situation include a tarp, extended cab, tonneau, or some other covering for the bed that can be removed. Other options include cargo containers for truck beds or luggage racks. Bulky or irregularly shaped cargo may not fit under truck caps and tonneau covers, so users often strap a bulky or irregularly shaped cargo to open truck beds when in transit.

Although tarps and similar coverings can offer some protection to the cargo from rain, dirt, and the like, loose straps and tarps are imperfect solutions. For instance, the cargo may still get wet because the tarp does not form a watertight seal with the truck, allowing water to collect on the truck bed and wet the cargo from underneath. In addition, cargo covered by a tarp is still vulnerable to theft because the tarp is neither puncture resistant nor lockable.

U.S. Pat. No. 2,803,491 discloses a flexible container for transporting bulk material in cargo trailer. The purpose of the invention is to protect bulk transport items from the elements. The flexible container relies on necessary structural support from the trailer frame. However, the cargo can only be accessed through the tapered rear portion of the container. Thus, this type of cargo bag is particularly designed for materials such as grain or wheat, and is not suitable for individual bulky or irregularly-shaped cargo.

U.S. Pat. No. 4,828,312 discloses a collapsible security storage apparatus for truck beds. This device has two rigid panels that essentially form a top and bottom of the container. The top panel is hinged to the truck bed sidewalls, and the invention is collapsible because these hinges can be undone and the top panel allowed to rest with the bottom panel in the truck bed. However, this invention is not designed to use the entire bed of the truck, so only a few small objects can be stored.

To ease in the transportation of large cargo, a cargo container should be flexible or soft-sided to accommodate individual bulky or irregularly shaped items. It is also desirable that a cargo container be able to secure the load within the container. Extant cargo containers do not combine all of the desired characteristics. There remains a need for a flexible cargo container designed for transporting and securing bulky or irregularly shaped cargo.

SUMMARY

In view of the foregoing, an object of the present disclosure is to address the need for a flexible cargo container designed for transporting and securing bulky or irregularly shaped cargo. Embodiments of the disclosure pertain to a cargo container for use in a pickup truck bed and a method for setting up the cargo container.

Disclosed herein is a cargo container for use in a pickup truck bed including a single-piece flexible shell. The flexible shell includes a base panel, a front wall panel, a back wall panel, two side wall panels, and a top cover panel. The base panel and the top cover panel can be substantially the same size and can be substantially in the shape of a truck bed. When the cargo container is in a closed configuration, the cargo container defines a closed chamber formed by a base, a front wall, a back wall, two side walls, and a top cover.

According to certain aspects of the disclosure, the flexible shell further includes a tailgate flap extending beyond the base panel. The tailgate flap is formed to prevent back-flowing water by folding the tailgate panel between the base panel and each of the side wall panels. The tailgate panel is configured to be sealed with the bottom inside corner of each of the side wall panels through a waterproof zipper, or the like.

In at least one embodiment, the shell includes at least one edge fastener fixed to a part of the perimeter of the flexible shell. In at least one embodiment, the flexible shell includes a plurality of edge fasteners attached to the edges of the back wall panel, two side wall panels and top cover panel. In another embodiment, the flexible shell further includes a plurality of edge fasteners attached to the left and right edges of the tailgate panel. The various edge fasteners may be selected from the group consisting of coil/spiral zippers, nylon zippers, metal zippers, plastic zippers, concealed zippers, water repellent zippers, buttons and buttonholes, hook and loop fasteners, hook and pile fasteners, latches, buckles, and clasps. In at least one embodiment, a first complementary component of the edge fastener is secured to the shell's interior surface and a second complementary component is secured to the shell's exterior surface. This allows portions of the shell to overlap when in the closed configuration, thus limiting the number of exposed seams to further protect the cargo from the elements.

In at least one embodiment, the shell includes at least one side access opening located in the side wall panels for providing access to the interior storage chamber, wherein the opening is capable of being sealed by a zipper or other suitable fastener.

The exterior surface of the flexible shell can include a plurality of exterior fasteners for tightening and securing the load. The exterior fastener, in other embodiments, may be coupled to the exterior surface of the shell. This exterior fastener may be any one or a combination of straps, loops, hooks, latches, clamps, and buckles. The exterior fastener may have complementary components that reversibly engage with one another. Variations in the exterior fastener allow the cargo container to be secured to itself, for example, by tightening a strap around the circumference of the container to keep the cargo in place. In at least one embodiment, the top cover panel includes a plurality of top straps. The top straps are preferably sewn to the top cover and have cleat hooks, or the like, on each end of the straps. The top strap is adjustable with a strap slide. The base panel includes a plurality of base straps. All the base straps are preferably sewn to the base panel and adjustable with a strap slide. The base straps have strap catches for receiving the cleat hooks on the corresponding top straps to fasten the top and base straps. In another embodiment, the back wall panel includes at least one top strap which is preferably sewn to the back wall panel and adjustable. The top strap on the back wall panel can have cleat hooks, or the like, on each end of the strap for receiving the catches of the corresponding base strap.

The interior surface of the flexible shell optionally includes a plurality of interior fasteners that allow a user to use ropes, straps, or the like to divide and/or secure the load within container. The interior fastener, fixed to the shell adjacent to the border, may have complementary components to reversibly secure to one another. The interior fasteners, in various embodiments, may be any one or a combination of catches, loops, hooks, latches, clamps, buckles, and dividers. This allows the interior fasteners to adapt to and secure cargo of various shapes and sizes. For example, strap fasteners can be used to strap or tie down large cargo, while hook fasteners can be hooked onto a cargo designed to receive the hook. Alternatively, the interior fasteners can function as a divider to secure smaller cargo that cannot be easily strapped or tied down.

In at least one embodiment, the flexible shell further includes at least one locking component that is fixed to the flexible shell proximate to the edge fastener.

In at least one embodiment, the flexible shell further includes at least one anchor that is fixed to the exterior surface of the flexible shell and configured to allow the flexible shell to be secured for transport. The anchor may include any one or combination of straps, loops, hooks, latches, clamps, buckles, and the like. These variations allow for securing the cargo container to externalities, like a truck bed.

The flexible shell, in some embodiments, may include one or any combination of waterproof materials, insulating materials, fireproof materials, and puncture proof materials. These materials protect the cargo from theft and the elements, such as precipitation and road debris (e.g., thrown gravel, dirt).

Also disclosed herein are methods for constructing a cargo container in a closed configuration. The method includes assembling a flexible shell to form a cargo chamber, securing the cargo container by exterior fasteners or anchors, and optionally securing the cargo within the cargo container by interior fasteners attached to the interior surface of the shell. The flexible shell is configured to be folded to form a cargo chamber, and flexible to accommodate bulky or awkwardly shaped cargo. In at least one embodiment, the shell includes at least one edge fastener attached to the edges of the shell so that when the edge fasteners are engaged to one another, the cargo container is in a closed configuration, and when the edge fasteners are disengaged, the cargo container is in an open or collapsed configuration.

At least one embodiment provides a method for constructing a cargo container in a closed configuration, including providing a single piece of a flexible shell having an interior surface and an exterior surface, wherein the flexible shell defines a cargo chamber formed by a base panel, a front wall panel, a back wall panel, two side wall panels, a top cover panel, and a tailgate panel; joining the front panel with each of the two side wall panels along edges of the front panel; joining the top cover panel with each of the two side wall panels along edges of the top cover panel; joining the tailgate panel with the two side wall panels along edges of the tailgate panel; joining the back wall panel with the two side wall panels along edges of the back wall panel; and fastening at least one exterior fastener attached to the exterior surface of the flexible shell.

In at least one embodiment, the method for constructing a cargo container in a closed configuration further includes securing a plurality of top straps attached to the top cover panel with the corresponding base straps attached to the base panel. The base straps have strap catches for receiving cleat hooks on the corresponding top straps to fasten the top and base straps. In another embodiment, the method for constructing a cargo container in a closed configuration further includes securing at least one top strap attached to the back wall panel with a corresponding base strap attached to the base panel. The top strap on the back wall panel has cleat hooks, or the like, on each end of the strap for receiving the catches of the corresponding base strap.

In at least one embodiment, the method for constructing a cargo container in a closed configuration further includes securing the cargo by interior fasteners attached to the interior surface of the shell.

In at least one embodiment, the method for constructing a cargo container in a closed configuration further includes fastening edge fasteners fixed to a part of a perimeter of the flexible shell. In some aspects of the methods, the edge fasteners can be any one or a combination of zippers, buttons and buttonholes, hook and loop fasteners, hook and pile fasteners, latches, buckles, and clasps.

Additionally, the flexible shell may have a collapsed configuration, where the shell includes a body and a perimeter portion. This configuration allows users to lay the cargo container flat where the interior surface faces generally upwards and the exterior surface faces generally downwards, to stack and secure cargo, and then to fold over the shell into a closed configuration. The collapsed configuration also allows for easy storage since it may be folded onto itself.

The foregoing and other aspects, features, details, utilities, and advantages of the present disclosure will be apparent from reading the following description and claims, and from reviewing the accompanying drawings.

BRIEF DESCRIPTION OF THE DRAWINGS

Aspects of the disclosure will be described in more detail below on the basis of one or more drawings, which illustrate exemplary embodiments.

DETAILED DESCRIPTION OF THE EMBODIMENTS

It should be understood that the disclosure is not limited to the particular apparatus, methodology, protocols, and systems, etc., expressly described herein and as such may vary. The terminology used herein is for the purpose of describing particular embodiments only and is not intended to limit the scope of the present disclosure, which is defined solely by the claims.

As used in the specification and appended claims, unless specified to the contrary, the following terms have the meaning indicated below.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The following description and the drawings sufficiently illustrate specific embodiments to enable those skilled in the art to practice them. Other embodiments may incorporate structural, logical, process, and other changes. Portions and features of some embodiments may be included in, or substituted for, those of other embodiments.

The present disclosure provides apparatuses and methods for cargo containers. To illustrate, several exemplary embodiments are described in detail herein. The apparatuses and methods described can be utilized in other contexts.

Figure 1:
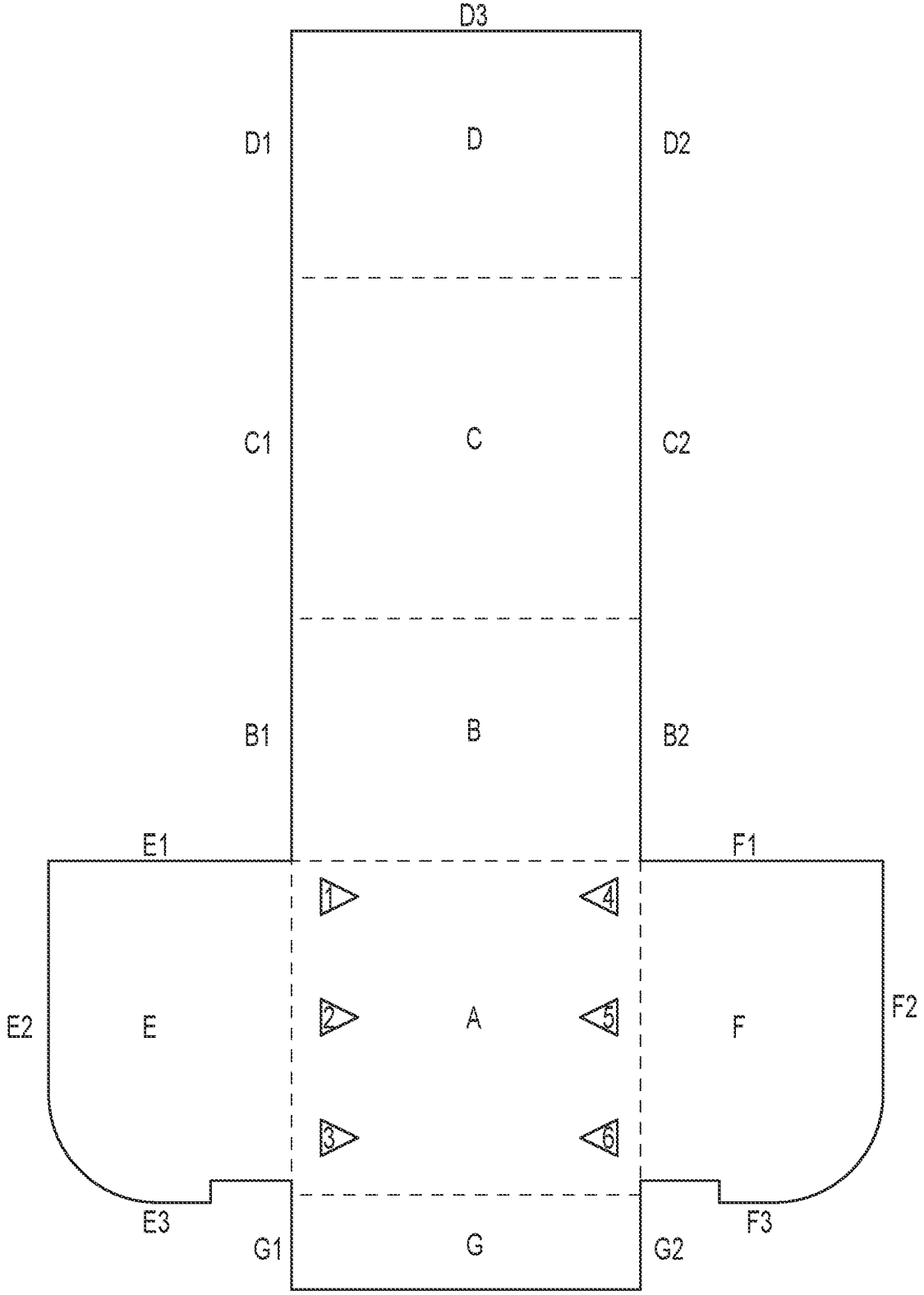
FIG. 1 depicts the interior surface of an exemplary flexible shell for a cargo container in a collapsed configuration.

FIG. 1 depicts the interior surface of an exemplary flexible shell for a cargo container in a collapsed, or open, configuration according to features of the present disclosure. The flexible shell includes a base panel (A), a front wall panel (B), a top cover panel (C), a back wall panel (D), two side wall panels (F. & F), and a tailgate panel (G). The base panel (A) is adjacent to the front wall panel (B), the two side wall panels (E & F) and the tailgate panel (G), all around the perimeter of the base panel (A). The two side wall panels (F & F) extend laterally from the perimeter of base panel (A) in opposite directions. The front wall panel (B) and the tailgate panel (G) extend longitudinally from the perimeter of base panel (A) in opposite directions. The top cover panel (C) is adjacent to the front wall panel (B). The base panel (A) and the top cover panel (C) are substantially the same size and are substantially in the shape of a truck bed (e.g., rectangular). The base panel (A) is adapted to be positioned within a truck bed. The length of the left edge (B1) and right edge (B2) of the front wall panel (B) matches with the length of the front edge (E1 & F1) of each side wall panel (E & F). Preferably, the side wall panels (E & F) include a rounded corner at the joint of the top edge (E2 or F2) and back edge (E3 or F3).

The flexible shell may be made of materials that naturally exhibit, or that are treated (e.g., with an appropriate reagent or appropriate reagents) to exhibit, various protective properties, such as waterproofing or water resistance, thermal insulation, fireproofing, puncture proofing, tear resistance, wear resistance, mold and mildew resistance, and the like. Various materials may also be layered together to achieve the foregoing objects of the disclosure. Suitable materials for flexible shell include, without limitation, heavy tarp, heavy duty nylon or canvas, vinyl plastic or a weather-resistant fabric.

Referring to FIG. 1, the flexible shell can include at least one edge fastener, such as a zipper, fixed to a part of the perimeter of the shell to effect, alternatively, closure or opening. A first zipper track can start from one end of the left edge (C1) of the top cover panel (C), passing along the left edge (C1) of the top cover panel (C) and the left edge (D1) of the back wall panel (D), and end a few inches away from the end edge (D3) of the back wall panel (D). A second zipper track can start from one end of the right edge (C2) of the top cover panel (C), passing along the right edge (C2) of the top cover panel (C) and the right edge (D2) of the back wall panel (D), and end a few inches away from the end edge (D3) of the back wall panel (D). A third zipper track that is complementary to the first zipper track can start from one end of the top edge (E2) of the side wall panel (F), passing along the top edge (E2) and back edge (E3) of the side wall panel (E). A fourth zipper track that is complementary to the second zipper track can start from one end of the top edge (F2) of the side wall panel (F), passing along the top edge (F2) and back edge (F3) of the side wall panel (F). A fifth zipper track can be fixed to the left edge (G1) of the tailgate panel (G) and a sixth zipper track can be fixed to the right edge (G2) of the tailgate panel (G). A seventh zipper track that is complementary to the fifth zipper track can be fixed to the end edge (E3) of the side wall panel (E) starting from the base end. An eighth zipper track that is complementary to the sixth zipper track can be fixed to the end edge (F3) of the side wall panel (F) starting from the base end.

Referring to FIG. 1, the interior surface of the shell optionally includes a plurality of interior fasteners (1-6) that allow a user to use ropes, straps, or the like to divide and/or secure the load within container. The interior fasteners, fixed to the base panel (A) adjacent to the border, can have complementary components to reversibly secure to one another. The interior fasteners, in various embodiments, may be any one or a combination of catches, loops, hooks, latches, clamps, buckles, and dividers. This allows the interior fasteners to adapt to and secure cargo of various shapes and sizes. For example, a strap fastener can be used to strap or tie down large cargo, while a hook fastener can be hooked onto cargo designed to receive the hook. Alternatively, the interior fasteners can function as dividers to secure smaller cargo that cannot be easily strapped or tied down.

Figure 2:
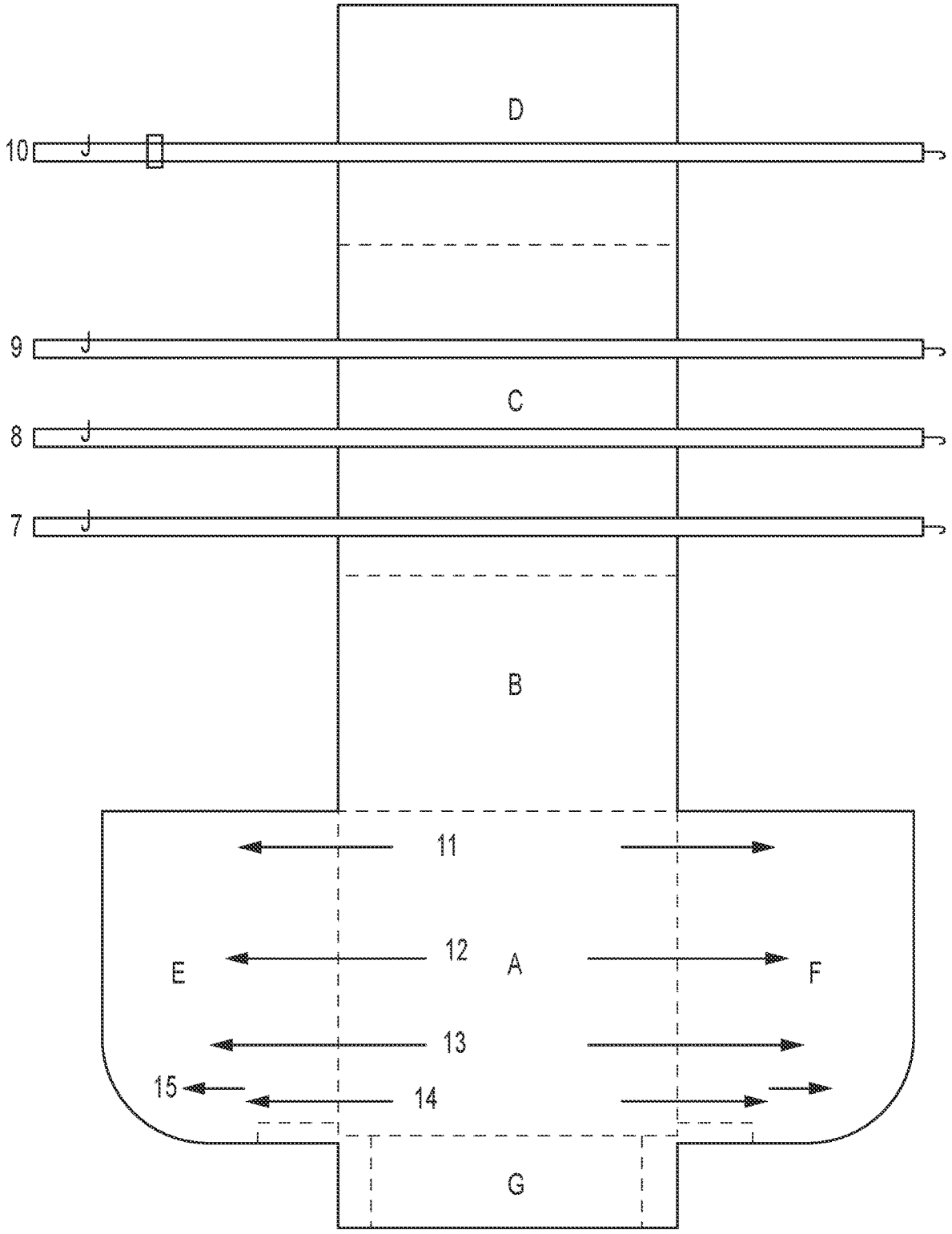
FIG. 2 depicts the exterior surface of an exemplary flexible shell for a cargo container in a collapsed configuration.

FIG. 2 depicts the exterior surface of an exemplary flexible shell for a cargo container in a collapsed, or open, configuration according to features of the present disclosure. The exterior surface of the shell can include a plurality of exterior fasteners for tightening and securing the load. The exterior fasteners, in other embodiments, may be coupled to the exterior surface of the shell. This exterior fasteners may be any one or a combination of straps, loops, hooks, latches, clamps, and buckles. The exterior fasteners should have complementary components that reversibly engage with one another. Variations in the exterior fasteners allow the cargo container to be secured to itself, for example, by tightening a strap around the circumference of the container to keep the cargo in place.

Referring to FIG. 2, the top cover panel (C) can include a plurality of top straps (7-9). The top straps may be sewn to the top cover and have cleat hooks, or the like, on each end of the straps. The top strap can be adjustable with a strap slide. The base panel (A) can include a plurality of base straps (11-15), All the base straps can be sewn to the base panel and can be adjustable with a strap slide. The base straps have strap catches for receiving the cleat hooks on corresponding the top straps to fasten and secure the top and base straps. The back wall panel (C) can include at least one top strap (10), which is sewn to the back wall panel (C) and may be adjustable. The top strap on the back wall panel (C) has cleat hooks, or the like, on each end of the strap for receiving the catches of the corresponding base strap (15).

Referring to FIGS. 1 and 2, to place the cargo container in a closed configuration, the front wall panel (B) and the two side wall panels (E & F) are folded up. The top cover panel (C) is folded over and the left (C1) and right (C2) edges are sealed with the top edges (E1 & F1) of the side wall panels (E & F) by edge fasteners, such as zippers. The tailgate panel (G) is folded up and its left (G1) and right (G2) edges are sealed with the back edges (E3 & F3) of the side wall panels (E & F) by zippers. Then, the back wall panel (D) is folded down and its left (D1) and right (D2) edges are sealed with the back edges (E3 & F3) of the side wall panels (E & Finally, the top straps are fastened with the corresponding base straps to secure the cargo container.

Figure 3A:
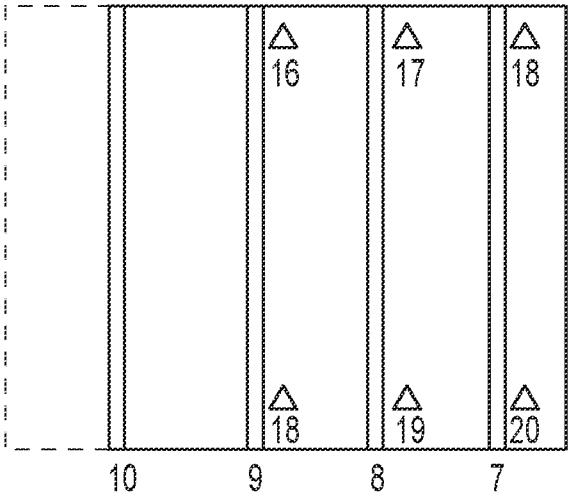
FIG. 3A depicts a top view of an exemplary cargo container in a closed configuration.
Figure 3B:
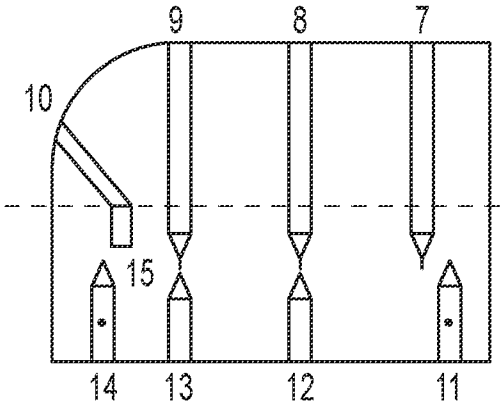
FIG. 3B depicts a side view of an exemplary cargo container in a closed configuration.
Figure 3C:
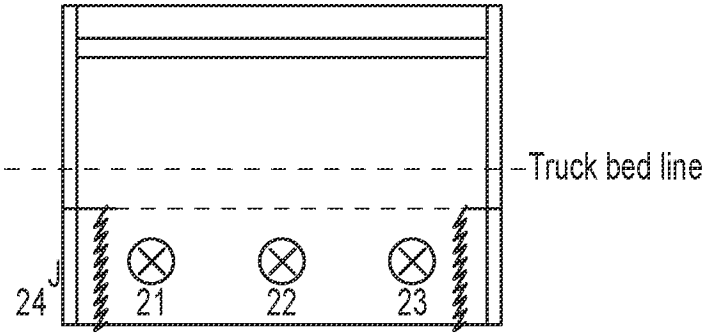
FIG. 3C depicts a back view of an exemplary cargo container in a closed configuration.

FIG. 3A depicts a top view of an exemplary cargo container in a closed configuration. The top cover panel and back wall panel include a plurality of top straps (7-10). Optionally, the top cover may further include tie-down catches (16-20) fixed to the top cover. FIG. 3B depicts a side view of an exemplary cargo container in a closed configuration, wherein the top straps (7-10) and base straps (11-15) are fastened through hook and catch exterior fasteners to secure the cargo. These exterior fasteners may be any one or a combination of straps, loops, hooks, latches, clamps, and buckles. FIG. 3C depicts a back view of an exemplary cargo container in a closed configuration. The tailgate panel optionally includes loop fasteners (21-23). The tailgate panel further optionally includes at least one anchor (24) fixed to exterior surfaces of shell and allow flexible shell to be secured for transport, such as on pickup trucks, flatbed trucks, and roof racks. Anchors (24) may include any one or combination of straps, loops, hooks, latches, clamps, buckles, and the like.

Figure 4:
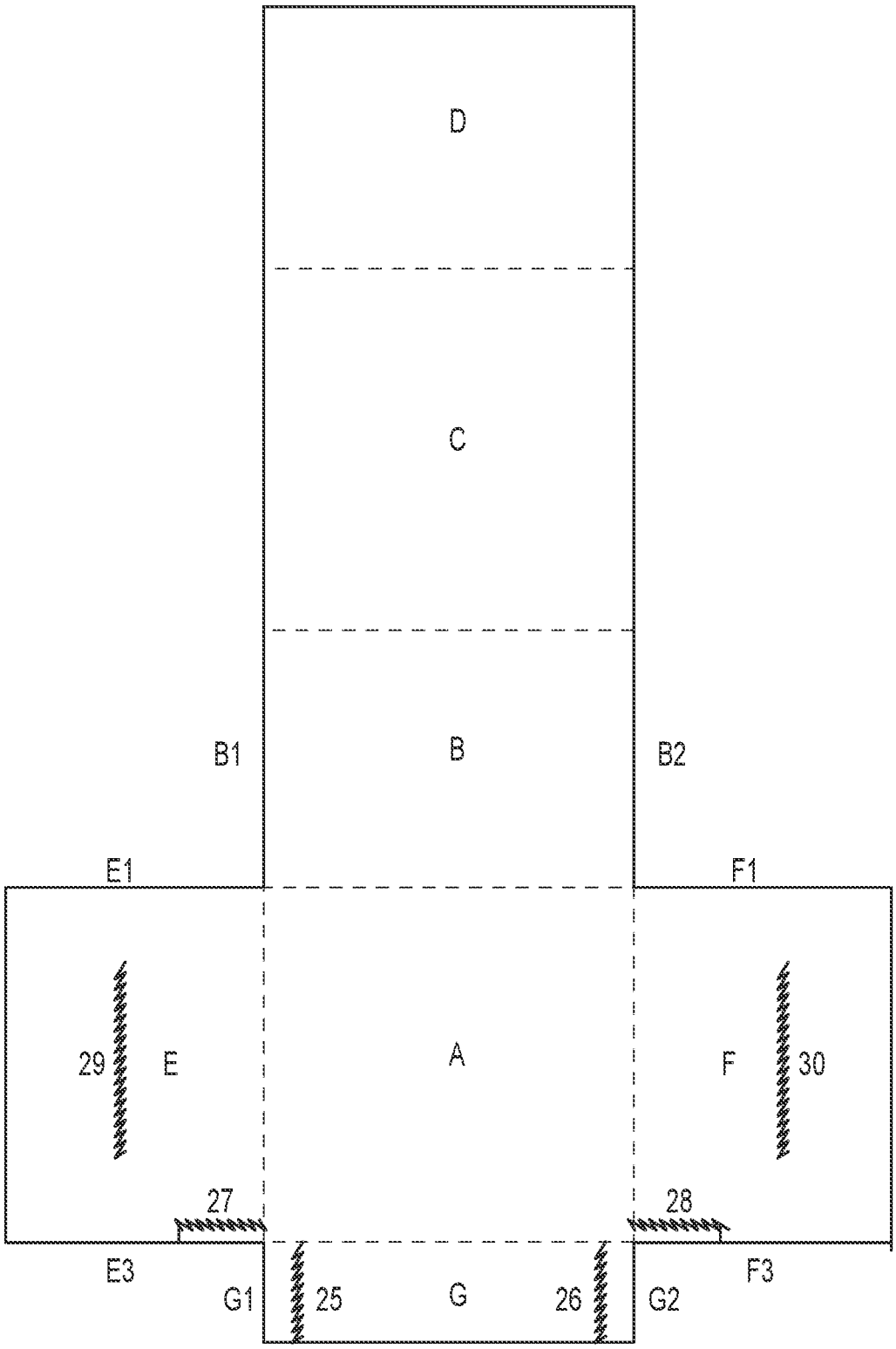
FIG. 4 depicts the interior surface of another exemplary flexible shell for a cargo container in a collapsed configuration.

FIG. 4 depicts the interior surface of another exemplary flexible shell for a cargo container in a collapsed, or open, configuration according to features of the present disclosure. The shell includes a base panel (A), a front wall panel (B), a top cover panel (C), a back wall panel (D), two side wall panels (E & F), and a tailgate panel (G). The base panel (A) is adjacent to the front wall panel (B), the two side wall panels (E. & F) and the tailgate panel (G), all around the perimeter of the base panel (A). The two side wall panels (E &. F) extend laterally from the perimeter of base panel (A) in opposite directions. The front wall panel (B) and the tailgate panel (G) extend longitudinally from the perimeter of base panel (A) in opposite directions. The front wall panel (B) optionally includes two seam flaps, each of a few inches in width and attached to the side edge (B1 or B2) of the side wall panel. The left side wall panel (E) optionally includes a seam flap of a few inches in width and attached to the front edge (E1) of the left side wall panel (E). The right side wall panel (F) optionally includes a seam flap of a few inches in width and attached to the front edge (F1) of the right side wall panel (F). The top cover panel (C) is adjacent to the front wall panel (B). The base panel (A) and the top cover panel (C) are substantially the same size and are substantially in the shape of a truck bed (e.g., rectangular). The base panel (A) is adapted to be positioned within the truck bed. The length of the front edge (E1 & F1) of each side wall panel (E & F) can be longer than the length of the left edge (B1) and right edge (B2) of the front wall pan& (B). For instance, the length of the front edge (E1 & F1) of each side wall panel (E & F) can be about 40 inches longer than the length of the left edge (B1) and right edge (B2) of the front wall panel (B).

Referring to FIG. 4, the flexible shell includes at least one edge fastener, such as a zipper, fixed to a part of the perimeter of the shell to effect, alternatively, closure or opening. A first zipper track (25) can be fixed to the left edge (G1) of the tailgate panel (G) and a second zipper track (26) can be fixed to the right edge (G2) of the tailgate panel (G). A third zipper track (27) complementary to the first zipper track can be fixed to the end edge (E3) of the side wall panel (E) starting from the base end. A fourth zipper track (28) that is complementary to the second zipper track can be fixed to the end edge (F3) of the side wall panel (F) starting from the base end.

Referring to FIG. 4, the shell includes at least one side access opening (29-30) located in the side wall panels (E & F) for providing access to the interior storage chamber, wherein the opening is configured to be reversibly sealed by zippers.

Figure 5:
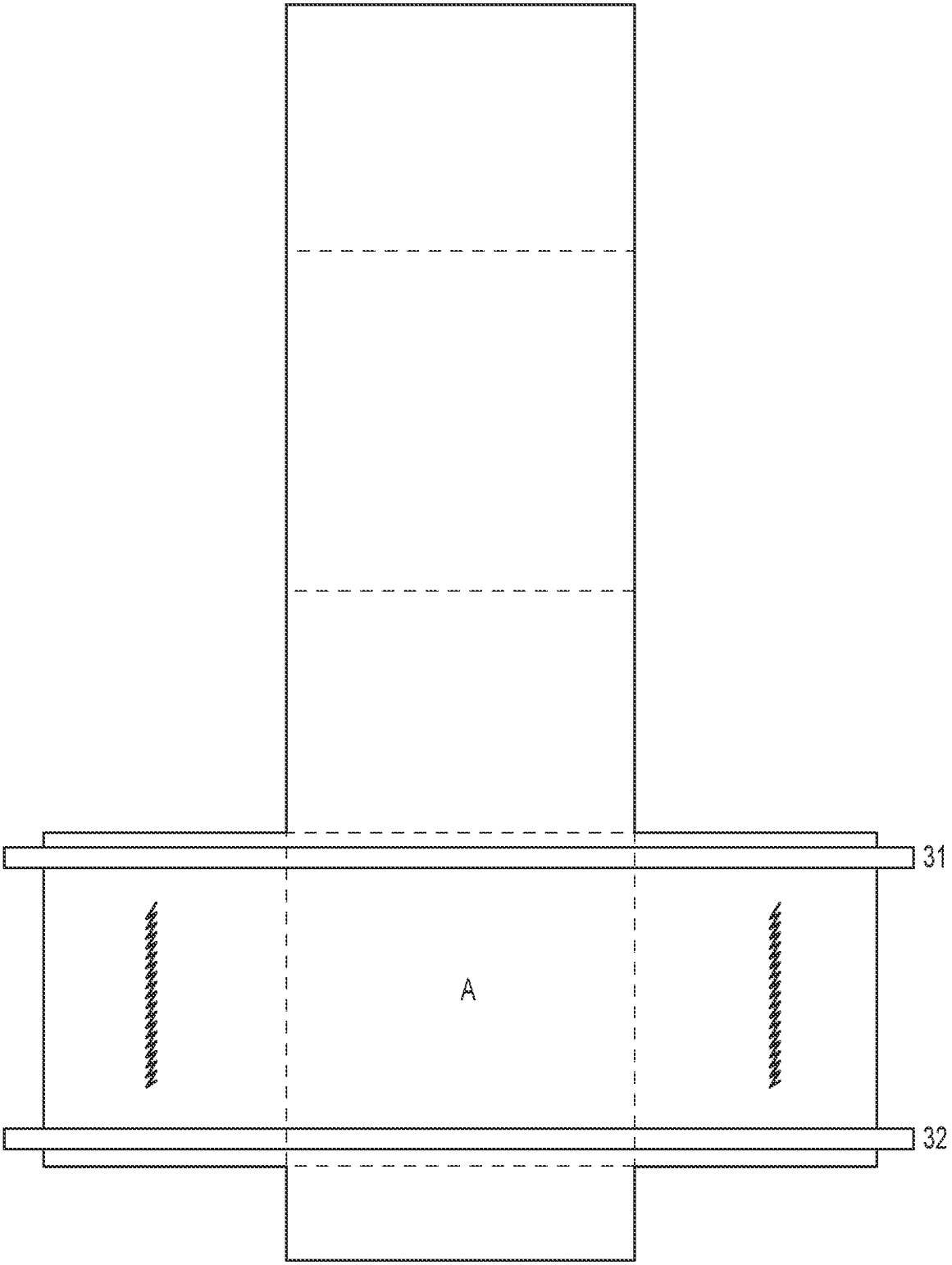
FIG. 5 depicts the exterior surface of another exemplary flexible shell for a cargo container in a collapsed configuration.

FIG. 5 depicts the exterior surface of another exemplary flexible shell for a cargo container in a collapsed, or open, configuration according to features of the present disclosure. Preferably, the exterior surface of the shell includes a plurality of exterior fasteners for tightening and securing the load. The exterior fasteners, in other embodiments, may be coupled to the exterior surface of the shell. These exterior fasteners may be any one or a combination of straps, loops, hooks, latches, clamps, and buckles. The exterior fasteners can have complementary components that reversibly engage with one another. Variations in the exterior fasteners allow the cargo container to be secured to itself, for example, by tightening a strap around the circumference of the container to keep the cargo in place. These variations also allow for securing the cargo container to externalities, like a truck bed.

Referring to FIG. 5, the base panel (A) includes a plurality of the base straps (31-32). All the base straps may be sewn to the base panel and may be adjustable with a strap slide. Each base strap has a strap catch, or the like, on one end and a cleat hook, or the like, on the opposite end of the base strap so that the base strap is configured to wrap around the cargo container to secure the cargo.

Figure 6:
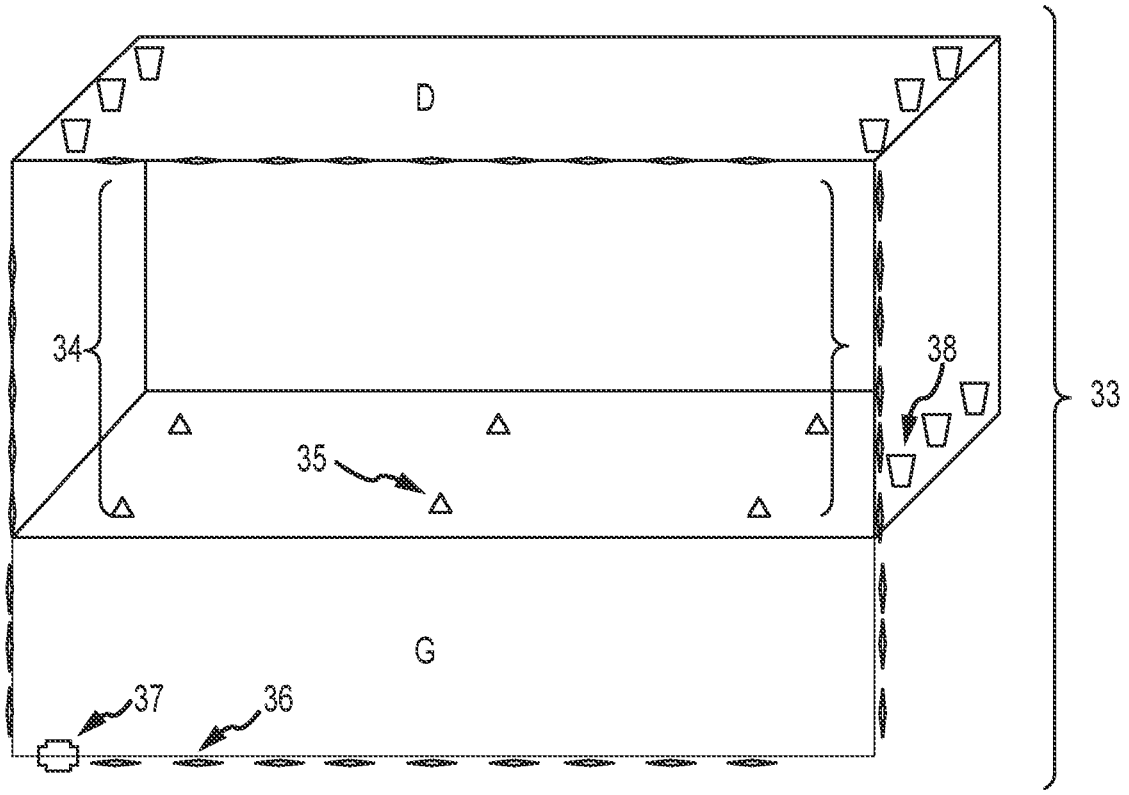
FIG. 6 depicts an exemplary cargo container in an open configuration.

FIG. 6 depicts an exemplary cargo container in an open configuration according to features of the present disclosure. The flexible shell (33) is in an open configuration, so cargo chamber (34) is accessible. The interior surface of the shell define the walls of the cargo chamber (34). In the open configuration, the back wall panel (D) is not folded down and tailgate panel (G) is not folded up so that one can access cargo chamber (34). Interior fasteners (35) are attached to interior surface of the shell (33).

Referring to FIG. 6, a lock (37) can be coupled to flexible shell (33) proximate to edge fasteners (36). When lock (37) is engaged, lock (37) supplements edge fasteners (36) in sealing the cargo container to prevent theft. Although only a single lock (37) is shown in FIG. 6, this is only for purposes of illustration; any number of locks (37) may be used to secure the contents of cargo chamber (34) without departing from the scope of the instant disclosure.

Referring to FIG. 6, anchors (38) are fixed to the exterior surface of flexible shell (33) and allow flexible shell (33) to be secured for transport, such as on pickup trucks, flatbed trucks, and roof racks. Anchors (38) may include any one or combination of straps, loops, hooks, latches, clamps, buckles, and the like.

Figure 7:
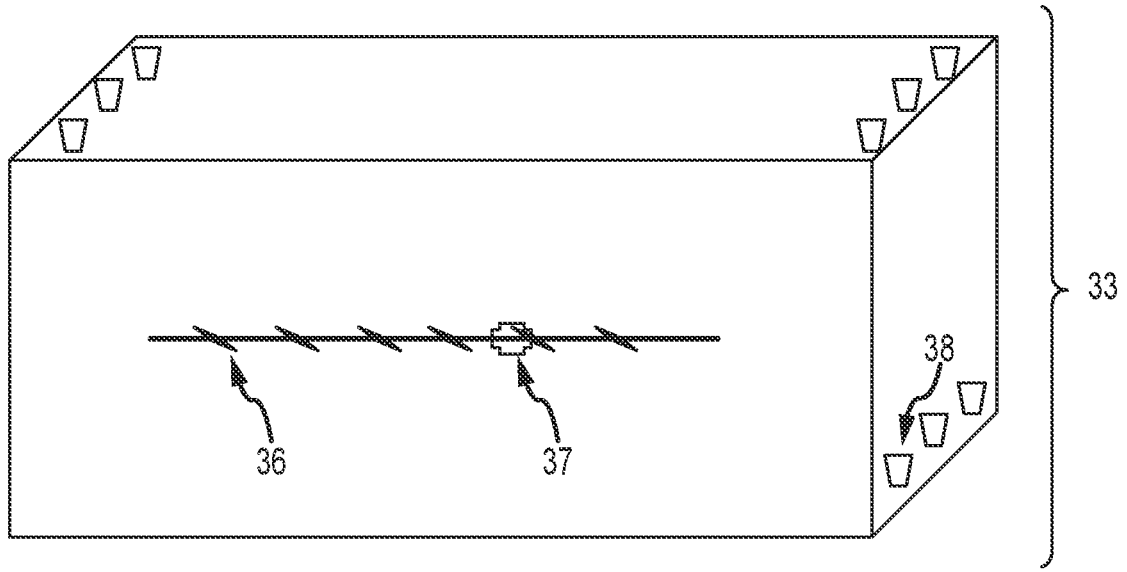
FIG. 7 depicts an exemplary cargo container in a closed configuration.

FIG. 7 depicts an exemplary cargo container in a closed configuration. In the closed configuration, edge fastener (36) is secured, such that access into cargo chamber is limited, thereby protecting cargo from theft, the elements, and the like.

In other embodiments, a flexible shell may include multiple pieces to form a base, a front wall, a back wall, two side walls, a top cover, and a tailgate. These pieces may be sewn, zippered, or otherwise sealed together (e.g., by laser welding).

In other embodiments, some edges of a base panel, a front wall panel, a back wall panel, two side wall panels, a top cover panel, and a tailgate panel may be sealed with the corresponding edges by permanent seams (e.g., sewn or laser welded).

In other embodiments, the cargo container may be used with a rigid internal support frame to provide support. The rigid internal support frame may be made of lightweight material including, but not limited to, plastic, aluminum or fiberglass tubes. The frame is substantially in the shape of a rectangular box. The frame is substantially in the same size of the cargo chamber so that the soft-sided cargo container is constructed to enclose the entire internal frame. Each panel of the flexible shell may be affixed to the internal frame by suitable fasteners, such as straps that loop around the frame and attach back to the flexible shell or hook and loop fasteners.

In still further embodiments, flaps or other suitable covers may be provided over exterior fasteners (e.g., along zipper runs) to further prevent the elements from intruding into the cargo chamber.

It is intended that all matter contained in the above description or shown in the accompanying drawings shall be interpreted as illustrative only and not limiting. Changes in detail or structure may be made without departing from the spirit of the disclosure as defined in the appended claims.

What is claimed is:

1. A cargo container, comprising:

a single piece of a flexible shell having an interior surface and an exterior surface, wherein the flexible shell defines a cargo chamber formed by a base panel, a front wall panel, a back wall panel, two side wall panels, a top cover panel, and a tailgate panel, wherein a front edge of each of the two side wall panels is longer than a left edge or a right edge of the front wall panel;

at least one interior fastener attached to the interior surface of the flexible shell, wherein the interior fastener is configured to secure cargoes of various shapes and sizes; and at least one exterior fastener attached to the exterior surface of the flexible shell, wherein the exterior fastener comprises complementary components that reversibly engage with one another and is configured to secure the cargo container, wherein the flexible shell further comprises at least one side access opening located in the side wall panel for providing access to the cargo chamber.

2. The cargo container of claim 1, wherein the flexible shell comprises at least one of (i) a waterproof material, (ii) an insulating material, (iii) a fireproof material, and (iv) a puncture proof material.

3. The cargo container of claim 1, wherein the flexible shell further comprises at least one edge fastener fixed to a part of a perimeter of the flexible shell.

4. The cargo container of claim 3, wherein the edge fastener is selected from a group consisting of coil/spiral zippers, nylon zippers, metal zippers, plastic zippers, concealed zippers, water repellent zippers, buttons and buttonholes, hook and loop fasteners, hook and pile fasteners, latches, buckles, and clasps.

5. The cargo container of claim 4, wherein the edge fastener is a zipper.

6. The cargo container of claim 3, wherein a first complementary component of the edge fastener is attached to the shell's interior surface and a second complementary component of the edge fastener is attached to the shell's exterior surface.

7. The cargo container of claim 3, further comprising at least one lock component coupled to the cargo container proximate to the edge fastener.

8. The cargo container of claim 1, wherein the front wall panel comprises two seam flaps, wherein the seam flap is of a few inches in width and attached to a side edge of the side wall panel.

9. The cargo container of claim 1, wherein the side wall panel comprises a seam flap, wherein the seam flap is of a few inches in width and attached to a front edge of the side wall panel.

10. The cargo container of claim 1, wherein the interior fastener comprises at least one of (i) a strap, (ii) a loop, (iii) a hook, (iv) a latch, (v) a clamp, (vi) a buckle, and (vii) a divider.

11. The cargo container of claim 1, wherein the exterior fastener comprises at least one of (i) a strap, (ii) a loop, (iii) a hook, (iv) a latch, (v) a clamp, and (vi) a buckle.

12. The cargo container of claim 1, further comprising at least one anchor comprising at least one of (i) a strap, (ii) a loop, (iii) a hook, (iv) a latch, (v) a clamp, and (vi) a buckle.

13. A method for constructing a cargo container in a closed configuration, comprising:

providing a single piece of a flexible shell having an interior surface and an exterior surface, wherein the flexible shell defines a cargo chamber formed by a base panel, a front wall panel, a back wall panel, two side wall panels, a top cover panel, and a tailgate panel, wherein the flexible shell further comprises at least one side access opening located in the side wall panel for providing access to the cargo chamber, and wherein a front edge of each of the two side wall panels is longer than a left edge or a right edge of the front wall panel;

joining the front wall panel with each of the two side wall panels along edges of the front panel;

joining the top cover panel with each of the two side wall panels along edges of the top cover panel;

joining the tailgate panel with the two side wall panels along edges of the tailgate panel;

joining the back wall panel with the two side wall panels along edges of the back wall panel; and fastening at least one exterior fastener attached to the exterior surface of the flexible shell.

14. The method of claim 13, wherein the flexible shell comprises at least one of (i) a waterproof material, (ii) an insulating material, (iii) a fireproof material, and (iv) a puncture proof material.

15. The method of claim 13, wherein the flexible shell further comprises at least one edge fastener fixed to a part of a perimeter of the flexible shell.

16. The method of claim 15, wherein the edge fastener is selected from a group consisting of coil/spiral zippers, nylon zippers, metal zippers, plastic zippers, concealed zippers, water repellent zippers, buttons and buttonholes, hook and loop fasteners, hook and pile fasteners, latches, buckles, and clasps.

17. The method of claim 15, wherein the edge fastener is a zipper.

18. The method of claim 15, wherein a first complementary component of the edge fastener is attached to the shell's interior surface and a second complementary component is attached to the shell's exterior surface.

19. The method of claim 15, further comprising fastening the edge fastener to seam a part of edges of the cargo container.

20. The method of claim 15, further comprising securing the cargo container by at least one lock coupled to the cargo container proximate to the edge fastener.

21. The method of claim 13, wherein the front wall panel comprises two seam flaps, wherein the seam flap is of a few inches in width and attached to a side edge of the side wall panel.

22. The method of claim 13, wherein the side wall panel comprises a seam flap, wherein the seam flap is of a few inches in width and attached to a front edge of the side wall panel.

23. The method of claim 13, further comprising securing cargoes inside the cargo container by an interior fastener selected from a group consisting of (i) a strap, (ii) a loop, (iii) a hook, (iv) a latch, (v) a clamp, (vi) a buckle, and (vii) a divider.

24. The method of claim 13, wherein the exterior fastener comprises at least one of (i) a strap, (ii) a loop, (iii) a hook, (iv) a latch, (v) a clamp, and (vi) a buckle.

25. The method of claim 13, further comprising securing the cargo container by at least one anchor comprising at least one of (i) a strap, (ii) a loop, (iii) a hook, (iv) a latch, (v) a clamp, and (vi) a buckle.

* * * * *